US005714840A

United States Patent [19]

Tanabe et al.

[11] Patent Number: 5,714,840

[45] Date of Patent: Feb. 3, 1998

[54] PLASMA DISPLAY PANEL

[75] Inventors: Ryuichi Tanabe; Naoki Sugimoto; Setsuro Ito; Jiro Chiba, all of Yokohama, Japan

[73] Assignee: Asahi Glass Company Ltd., Tokyo, Japan

[21] Appl. No.: 611,131

[22] Filed: Mar. 5, 1996

[30] Foreign Application Priority Data

Mar. 7, 1995 [JP] Japan ..... 7-047315

[51] Int. Cl.[6] ..... H01J 61/067

[52] U.S. Cl. ..... 313/581; 313/257; 313/258; 313/268; 313/288; 313/289; 313/292

[58] Field of Search ..... 313/581, 584, 313/585, 586, 245, 250, 257, 258, 262, 268, 288, 289, 292; 501/11, 18, 23, 24, 38, 45, 46, 48, 51, 52, 59, 62, 63, 66, 68, 69, 100, 101, 102, 103, 105–107, 134, 142, 153, 154

[56] References Cited

U.S. PATENT DOCUMENTS

| | | | |
|---|---|---|---|
| 5,182,489 | 1/1993 | Sano | 313/586 X |
| 5,247,227 | 9/1993 | Park | 313/586 X |
| 5,315,213 | 5/1994 | Kim | 313/586 X |
| 5,317,231 | 5/1994 | Lee | 313/268 X |
| 5,396,149 | 3/1995 | Kwon | 313/586 X |
| 5,440,201 | 8/1995 | Martin et al. | 313/585 X |
| 5,541,479 | 7/1996 | Nagakubo | 313/586 |

FOREIGN PATENT DOCUMENTS 0 722 179 7/1996 European Pat. Off. .

OTHER PUBLICATIONS

Berezhnoi, A.; Glass–Ceramics and Photo–sitalls, pp. 9–20, Dec. 1970.

*Primary Examiner*—Ashok Patel
*Attorney, Agent, or Firm*—Oblon, Spivak, McClelland, Maier & Neustadt, P.C.

[57] ABSTRACT

A plasma display panel comprising mutually opposing substrates and barrier ribs formed between adjacent pixels of a display between the substrates, wherein the barrier ribs are made of a fired product of a glass ceramic composition consisting essentially of a glass powder of $P_2O_5$ type glass and a low expansion ceramic powder.

5 Claims, 1 Drawing Sheet

PLASMA DISPLAY PANEL

BACKGROUND OF THE INVENTION

1. Field of the Invention

The present invention relates to a plasma display panel (hereinafter referred to as PDP).

2. Discussion of Background

PDP has operative cells partitioned by barrier ribs, so that plasma discharge takes place in the spaces, whereupon a phosphor emits a color. Conventional barrier ribs are produced by firing a glass ceramic composition containing a lead component. Such conventional barrier ribs have a relatively large dielectric constant of a level of from 10 to 12, whereby they have had a problem that an electric signal is likely to leak to adjacent wires, and crosstalk is likely to result in the picture image. Further, the glass ceramic composition containing a lead component has a high density, whereby the substrate tends to be heavy. As compared with a dielectric film or a sealing material, the barrier ribs are substantially thick in the thickness and large in the area. Accordingly, they are influential substantially over the weight of the substrate in the production process. Therefore, if a lead-containing frit is employed, there will be a problem in handling the substrate during the production process due to its weight.

Further, there is a problem that "warpage" is likely to result during the firing of the substrate in the production process. In a usual firing step, it is common to support the substrate at a few points from under the substrate in order to prevent non-uniformity in heating. If the substrate is heavy, warpage is likely to result by its own weight.

Especially when the thermal expansion coefficients of the glass ceramic composition and the PDP substrate do not match well, a trouble is likely to result such that the substrate undergoes a warpage when a paste is screen-printed and fired.

SUMMARY OF THE INVENTION

Accordingly, it is an object of the present invention to provide PDP which has little crosstalk and a low density and which is free from a problem in its production, such as warpage of the substrate.

The present invention provides a plasma display panel comprising mutually opposing substrates and barrier ribs formed between adjacent pixels of a display between the substrates, wherein the barrier ribs are made of a fired product of a glass ceramic composition consisting essentially of a glass powder of $P_2O_5$ type glass and a low expansion ceramic powder.

DETAILED DESCRIPTION OF THE PREFERRED EMBODIMENTS

Figure 1:
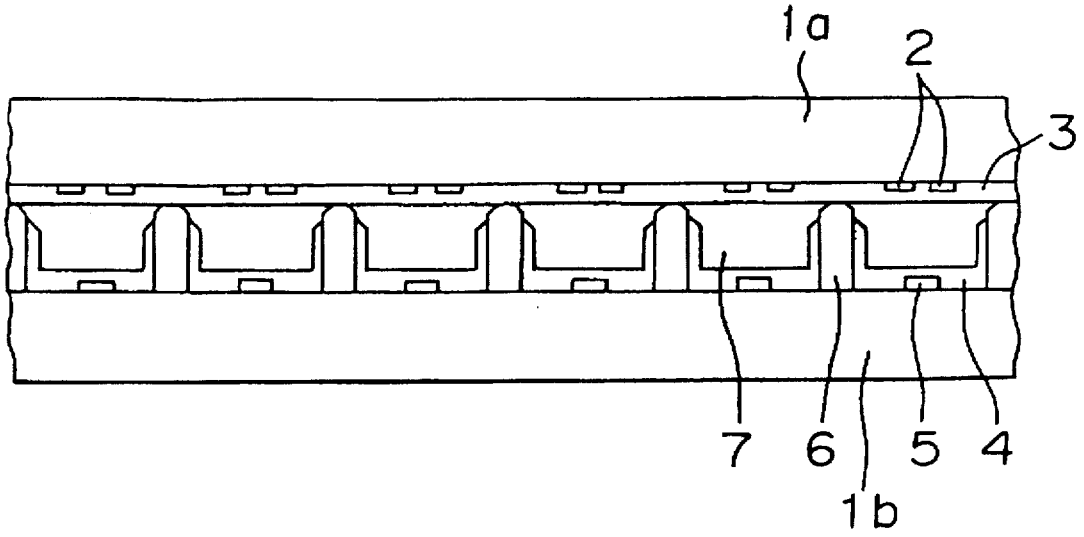
FIG. 1 is a cross-sectional view of PDP to which the present invention can be applied.

In PDP of the present invention, to form barrier ribs on a substrate for PDP, the above glass ceramic powder is formed into a paste, which is then screen-printed in a predetermined pattern, followed by firing at a temperature of from 500° to 600° C. for from 5 to 20 minutes, to form the barrier ribs. Otherwise, the above paste may be printed over the entire surface of the substrate, and then processed to form a pattern of barrier ribs. For example, it is possible to employ a method wherein a photosensitive resin is mixed in the paste, so that the pattern of barrier ribs can be formed by photolithography, or a method wherein the pattern of barrier ribs is formed by sandblasting.

In the present invention, the glass ceramic composition to be used for forming the barrier ribs, contains a glass powder of $P_2O_5$ type. Such a glass ceramic composition has a low dielectric constant and a low density. Besides, it has adequate fluidity at a temperature of from 500° to 600° C., and the glass powder and the ceramic powder are sufficiently wetted to form a thick film of the glass ceramic composition. Further, the thermal expansion coefficient thereof matches that of the PDP substrate.

If the content of such a glass powder is small, the ceramic powder can not adequately be wetted, whereby dense sintering tends to be difficult, and the strength of barrier ribs tends to be low. On the other hand, if it is large, the shrinkage upon firing tends to be too large. Therefore, in the present invention, the content of the glass powder is preferably from 20 to 70 wt % of the entire glass ceramic composition.

On the other hand, the low expansion ceramic powder is preferably at least one member selected from the group consisting of alumina, zircon, cordierite, mullite, silica, β-eucryptite, β-spodumene and β-quartz solid solution, since these materials have small thermal expansion coefficients and have a characteristic that, when combined with the glass powder, they provide a thermal expansion coefficient which matches the PDP substrate.

If the particle size of the glass powder or the ceramic powder is too small, it is likely to be difficult to form a paste. On the other hand, if the particle size of the glass powder or the ceramic powder is too large, no adequately dense sintered layer can be formed at the time of firing, and many voids are likely to form. Therefore, in the present invention, the average particle size of the glass powder is preferably within a range of from 1 to 10 μm, and the average particle size of the ceramic powder is preferably within a range of from 0.1 to 10 μm.

If the thermal expansion coefficient of the glass ceramic composition for forming the barrier ribs is small, warpage of the substrate is likely to result, when the composition is printed and fired to form a thick film on the substrate. On the other hand, if the thermal expansion coefficient is too large, cracks are likely to form or warpage is likely to result in the overcoat of the primer, whereby the substrate is likely to break. Taking into consideration the average thermal expansion coefficient of glass commonly used as the PDP substrate being from $78\times10^{-7}$/°C. to $88\times10^{-7}$/°C. from room temperature to 300° C., the average thermal expansion coefficient after firing of the glass ceramic composition of the present invention is preferably from $63\times10^{-7}$/°C. to $90\times10^{-7}$/°C. from room temperature to 300° C. The average thermal expansion coefficient after firing of the glass ceramic composition can appropriately be adjusted depending upon the thermal expansion coefficient of the PDP substrate.

In the present invention, the glass powder preferably has a composition within the following ranges. Namely, the glass powder preferably consists essentially of from 25 to 45 mol % of $P_2O_5$, from 0 to 50 mol % of ZnO, from 0 to 70 mol % of SnO, from 0 to 10 mol % of $Li_2O$, from 0 to 10 mol % of $Na_2O$, from 0 to 10 mol % of $K_2O$, from 0 to 20 mol % of $Li_2O+Na_2O+K_2O$, from 0 to 10 mol % of MgO, from 0 to 10 mol % of CaO, from 0 to 10 mol % of SrO, from 0 to 10 mol % of BaO, from 0 to 20 mol % of MgO+CaO+SrO+BaO, from 0 to 10 mol % of $B_2O_3$, and from 0 to 10 mol % of $Al_2O_3$.

In such a composition, if the content of $P_2O_5$ is too small, vitrification tends to be difficult. Further, the softening point tends to be too high, whereby the fluidity will be poor, and the ceramic powder can not adequately be wetted, thus leading to a decrease in the strength. On the other hand, if it is too large, the water resistance tends to be poor. More preferably it is at least 27 mol % and at most 40 mol %.

ZnO is not essential. However, when it is incorporated in an amount of at least 5 mol %, it provides an effect of lowering the thermal expansion coefficient of the fired product. On the other hand, if it is too large, vitrification tends to be difficult. Therefore, it is preferably at most 50 mol %, more preferably at most 30 mol %.

SnO is not essential. However, it is preferred to incorporate it in an amount of at least 5 mol %, whereby it provides an effect of lowering the softening point. On the other hand, if it is too much, vitrification tends to be difficult. More preferably it is at least 30 mol % and at most 60 mol %.

$Li_2O$, $Na_2O$ and $K_2O$ are not essential. However, when at least one of them is incorporated in an amount of at least 0.1 mol %, it is possible to improve the adhesion of the barrier ribs to the PDP substrate glass. On the other hand, if it is too much, crystallizability tends to increase, and the fluidity during firing tends to be impaired. Therefore, each of them is preferably at most 10 mol %, more preferably at most 5 mol %, and the total amount is preferably at most 20 mol %, more preferably at most 10 mol %.

MgO, CaO, SrO and BaO are not essential. However, if at least one of them is preferably incorporated in an amount of at least 0.5 mol %, it is possible to improve the adhesion to the PDP substrate glass. On the other hand, if it is too much, the softening point of the glass powder tends to be too high, and the fluidity at the time of firing tends to be impaired. Therefore, each of them is preferably at most 10 mol %, more preferably at most 5 mol %, and the total amount is preferably at most 20 mol %, more preferably at most 10 mol %.

$B_2O_3$ is not essential. However, when it is preferably incorporated in an amount of at least 0.5 mol %, it provides an effect of lowering the thermal expansion coefficient. On the other hand, if it is too much, the softening point tends to be too high, and the fluidity at the time of firing tends to be impaired. Therefore, it is preferably at most 10 mol %, more preferably at most 8 mol %.

$Al_2O_3$ is not essential. However, when it is preferably incorporated in an amount of at least 0.1 mol %, it is possible to lower the thermal expansion coefficient of the fired body. On the other hand, if it is too much, the softening point of the glass tends to be too high, and the fluidity tends to be poor. Therefore, it is preferably at most 10 mol %, more preferably at most 8 mol %.

To impart a black color, a heat resistant black pigment (such as a Co—Cr—Fe type oxide, a Fe—Mn—Al type oxide or a Cu—Cr type oxide) may be added, or to impart a white color, a white pigment (such as $TiO_2$) may be added, to the glass ceramic composition of the present invention, in an amount of up to 30 wt %, based on the total amount of the glass powder and the ceramic powder. For example, at the top of the barrier ribs, black barrier ribs portions may be formed, so that the top portions of the barrier ribs look black through the front substrate, or white barrier ribs portions are likewise formed so that the top portions of the barrier ribs look white through the front plate.

PDP of the present invention can be prepared, for example, in the following manner.

An organic vehicle comprising an organic resin binder and a solvent is added to the above-described glass ceramic composition, followed by kneading to obtain a paste. As the organic resin binder and the solvent, those commonly used in the field of preparing glass pastes may be employed. For example, as the organic resin binder, ethyl cellulose or nitro cellulose may be used, and as the solvent, α-terpineol, butylcarbitol acetate or 2,2,4-trimethyl-1,3-pentanediol monoisobutylate, may be used.

To the paste, a surfactant may be incorporated as a dispersant. Further, in a case where a pattern of barrier ribs is formed by photolithography, a photosensitive resin is incorporated to the paste.

Then, the preparation is carried out in the following manner, for example, in a case where a PDP panel of alternate current system is to be prepared.

As shown in FIG. 1, on a front glass plate 1*a*, patterned electrodes 2 and bus bars (not shown) are formed, and then a transparent dielectric layer 3 is formed.

On the other hand, on a rear side glass plate 1*b*, patterned addressing electrodes 5 are formed, and then barrier ribs 6 are formed in a stripe pattern.

The barrier ribs 6 are formed in the following manner. Firstly, the paste prepared as described above, is screen-printed in a predetermined pattern, followed by drying. Then, this printing and drying operation is repeated until the film thickness after drying the paste will be about 200 to 300 μm. Here, at the top of the barrier ribs, a paste prepared by adding from 1 to 30 wt % of a heat resistant black pigment to the same glass ceramic composition as used for the barrier ribs, may be printed to form black-colored barrier ribs. Then, the paste is fired at a temperature of from 500° to 600° C. for from 5 to 20 minutes to obtain barrier ribs 6.

Then, a phosphor layer 4 is printed, and then a sealing material (not shown) is coated by a dispenser along the periphery of the glass plates 1*a* and 1*b*. The substrates are assembled so that the electrodes of the respective substrates face each other to form a panel, followed by firing to obtain a plasma display panel. Then, the interior of the plasma display panel is evacuated, and a discharge gas such as neon or He—Xe is sealed-in in discharge spaces 7.

In the above example, the present invention is described with respect to an alternate current system. However, the present invention is applicable also to a direct current system.

The paste for barrier ribs may be printed in any pattern of cell-form, stripe-form or solid printing. However, when solid printing is applied, post-processing is required to form a predetermined pattern. For example, cell-form or stripe-form patterning may be carried out by e.g. photolithography, etching or sand blasting.

Now, the present invention will be described in further detail with reference to Examples. However, it should be understood that the present invention is by no means restricted to such specific Examples.

EXAMPLES 1 to 12

A raw material slurry obtained by dropwise adding 85% orthophosphoric acid to solid raw materials for the glass component except for $P_2O_5$, was thoroughly mixed and then dried at 120° C. to obtain a powder batch material. This material was put into a quartz crucible and, after placing a lid thereon, melted at a temperature of from 1000° to 1100° C., followed by water granulation or roller processing to obtain flaky glass. Then, this flaky glass was pulverized by a ball mill for a predetermined period of time so that the average particle size became from 1 to 10 μm, to obtain a glass powder as identified in Table 1 or 2. Then, a low expansion ceramics is pulverized so that the average particle size became from 0.1 to 10 μm, to obtain a low expansion ceramic powder.

Then, such a glass powder and a ceramic powder, and a pigment, were mixed in the proportions as identified in Table 1 or 2 to obtain a composition. However, the amount of the pigment disclosed in each Table is the proportion to the total amount of the glass powder and the ceramic powder. In Example 5, a black pigment (Co—Cr—Fe type) was used, and in Example 7, a white pigment ($TiO_2$) was used.

Then, an organic vehicle comprising ethyl cellulose as an organic resin binder and α-terpineol as a solvent, was added thereto, followed by kneading to obtain a paste having a viscosity of about 200,000 cps.

As the glass substrate for PDP, one having an average thermal expansion coefficient of $80\times10^{-7}$/°C. from room temperature to 300° C., was used. On a glass substrate having electrodes formed beforehand, a thick film of this paste was formed in a predetermined barrier rib pattern. Namely, screen printing and drying were repeated, so that the film thickness after drying became 250 μm. Then, the thick film was fired at 520° C. for 15 minutes to form barrier ribs.

Then, a phosphor was coated on the side and bottom portions of the barrier ribs, and a sealing material was further coated along the periphery of the substrate. Then, the substrate was combined with a front plate having electrodes and a dielectric layer formed beforehand and maintained at a temperature of 470° C. for 15 minutes for sealing. Then, the interior was evacuated, and a discharge gas was sealed-in.

The dielectric constants after firing of the glass ceramic compositions in Tables 1 and 2 were within a range of from 7 to 10. When barrier ribs are formed by using such glass ceramic compositions, crosstalk can effectively be reduced as compared with a case where conventional barrier ribs containing lead were employed. Further, the densities after firing of the glass ceramic compositions in Tables 1 and 2 were all within a range of 3 to 4 g/cc. The densities of the barrier ribs prepared by using conventional glass frits containing lead as the main component, are at a level of from 5 to 6 g/cc. Thus, with PDP of the present invention, a substantial reduction in weight of PDP is possible.

Especially, glass ceramic compositions of Examples 1 to 8 well match the substrate in the thermal expansion coefficient and the residual stress and have high strength, and thus, they have very desirable properties for the production of PDP.

Various properties shown in the Tables were measured as follows.

Thermal expansion coefficient

A powder of the glass ceramic composition was compression-molded and then fired at 520° C. for 15 minutes to obtain a sintered body, which was polished into a predetermined size, whereupon measurement by a dilatometer was carried out. The elongation was measured under a condition of a temperature-raising rate of 10° C./min, whereupon the average thermal expansion coefficient from room temperature to 300° C. was calculated.

Residual stress

The paste prepared by adding the organic vehicle to the glass composition, followed by kneading, was screen-printed on a PDP substrate glass having an average thermal expansion coefficient of $80\times10^{-7}$/°C. from room temperature to 300° C., followed by firing at 520° C. for 15 minutes to obtain a film thickness of 200 μm. The residual strain formed between the substrate glass and the glass ceramic composition was measured by using a polarimeter (unit: nm/cm, "+" indicates a compression strain of the composition, and "−" indicates a tensile strain of the composition). The desirable range of the residual strain is from −60 to +300 nm/cm.

Warpage of the substrate

Printing was carried out on a substrate having a size of 50 cm×50 cm, followed by firing, whereupon the difference between the center portion and the most warped edge portion was measured. "+" indicates that the center portion is convex, and "−" indicates that the center portion is concave.

Strength

A powder of the glass ceramic composition was compression-molded and fared at 520° C. for 15 minutes. The sintered body was processed to a size of 4 mm in width×3 mm in thickness×60 mm in length and then polished by abrasive grains of #1000, whereupon the strength at breakage was determined by a three point bending test.

Shrinkage upon firing

The shrinkage upon firing was calculated by the formula $(t_0-t_1)/t_0\times100$ (%), wherein $t_0$ is the film thickness after printing and drying the paste, and $t_1$ is the film thickness after firing it.

TABLE 1

| Examples | | | 1 | 2 | 3 | 4 | 5 | 6 |
|---|---|---|---|---|---|---|---|---|
| Glass composition (mol %) | $P_2O_5$ | | 33 | 31 | 29 | 30 | 40 | 33 |
| | ZnO | | 5 | 0 | 16 | 10 | 25 | 20 |
| | SnO | | 59 | 65 | 54 | 56 | 16 | 46 |
| | $Li_2O$ | | 0 | 0.5 | 0 | 0 | 3 | 0 |
| | $Na_2O$ | | 0 | 0 | 0 | 0 | 4 | 0 |
| | $K_2O$ | | 0 | 0 | 0 | 0 | 4 | 0 |
| | MgO | | 1 | 0.5 | 0 | 0 | 2 | 0 |
| | CaO | | 1 | 0 | 0 | 0 | 0 | 0 |
| | BaO | | 0 | 0 | 2 | 1 | 3 | 0 |
| | SrO | | 0 | 1 | 0 | 0 | 0 | 0 |
| | $B_2O_3$ | | 0 | 2 | 0 | 3 | 0 | 0 |
| | $Al_2O_3$ | | 1 | 0 | 0 | 0 | 3 | 1 |
| Glass ceramic composition (wt %) | Glass powder | | 40 | 62 | 36 | 56 | 61 | 30 |
| | Ceramic powder | Zircon | | | 23 | | | 20 |
| | | Cordierite | | 38 | | | 20 | |
| | | Alumina | 60 | | 41 | 44 | | 50 |
| | | Mullite | | | | | | |

TABLE 1-continued

| Examples | | 1 | 2 | 3 | 4 | 5 | 6 |
|---|---|---|---|---|---|---|---|
| | Silica | | | | | 12 | |
| | β-Eucryptite | | | | | 1 | |
| | β-Spodumene | | | | | 1 | |
| | β-Quartz solid solution | | | | | 5 | |
| | Added pigment | | | | 10 Black | | |
| Average particle size (μm) | Glass powder | 5.0 | 7.3 | 2.8 | 3.6 | 5.3 | 4.1 |
| | Ceramic powder | 2.0 | 3.0 | 0.5 | 2.8 | 6.0 | 3.0 |
| Properties | Thermal expansion coefficient ($\times 10^{-7}$/°C.) | 68 | 72 | 65 | 75 | 76 | 71 |
| | Residual strain (nm/cm) | +110 | +50 | +160 | +30 | +10 | +60 |
| | Warpage of the substrate (mm) | +0.6 | +0.2 | +0.8 | +0.2 | +0.1 | +0.3 |
| | Strength of the composition (kg/cm$^2$) | 1900 | 1000 | 1600 | 2000 | 1200 | 1600 |
| | Shrinkage upon firing (%) | 6 | 16 | 10 | 8 | 9 | 1 |

TABLE 2

| Examples | | 7 | 8 | 9 | 10 | 11 | 12 |
|---|---|---|---|---|---|---|---|
| Glass composition (mol %) | $P_2O_5$ | 35 | 33 | 15 | 35 | 50 | 36 |
| | ZnO | 45 | 44 | 30 | 15 | 30 | 25 |
| | SnO | 0 | 0 | 50 | 40 | 10 | 35 |
| | $Li_2O$ | 5 | 7 | 1 | 5 | 3 | 1 |
| | $Na_2O$ | 3 | 7 | 1 | 0 | 0 | 0 |
| | $K_2O$ | 3 | 6 | 0 | 0 | 0 | 0 |
| | MgO | 3 | 0 | 2 | 2 | 0 | 0 |
| | CaO | 0 | 0 | 0 | 1 | 0 | 0 |
| | BaO | 3 | 0 | 0 | 0 | 0 | 1 |
| | SrO | 0 | 0 | 0 | 0 | 0 | 0 |
| | $B_2O_3$ | 1 | 1 | 0 | 2 | 5 | 0 |
| | $Al_2O_3$ | 2 | 2 | 1 | 0 | 2 | 2 |
| Glass ceramic composition (wt %) | Glass powder | 58 | 49 | 55 | 15 | 60 | 80 |
| | Ceramic powder: Zircon | 10 | 21 | | | 10 | |
| | Ceramic powder: Cordierite | 10 | | 10 | | | 10 |
| | Ceramic powder: Alumina | | 20 | 35 | 50 | 30 | 10 |
| | Ceramic powder: Mullite | | | | 15 | | |
| | Ceramic powder: Silica | 2 | 5 | | 20 | | |
| | Ceramic powder: β-Eucryptite | 5 | | | | | |
| | Ceramic powder: β-Spodumene | 10 | | | | | |
| | Ceramic powder: β-Quartz solid solution | 5 | 5 | | | | |
| | Added pigment | 5 White | | | | | |
| Average particle size (μm) | Glass powder | 6.0 | 3.2 | 3.0 | 5.6 | 5.2 | 5.0 |
| | Ceramic powder | 6.5 | 5.1 | 5.0 | 2.0 | 2.5 | 3.5 |
| Properties | Thermal expansion coefficient ($\times 10^{-7}$/°C.) | 78 | 79 | 70 | 75 | 98 | 103 |
| | Residual strain (nm/cm) | −10 | −20 | +80 | +30 | −900 | −1200 |
| | Warpage of the substrate (mm) | −0.1 | −0.2 | +0.5 | +0.2 | −6.0 | −7.0 |
| | Strength of the composition (kg/cm$^2$) | 1000 | 1200 | 200 | 150 | 800 | 400 |
| | Shrinkage upon firing (%) | 12 | 20 | 5 | 0.5 | 25 | 35 |

The dielectric constant of the barrier ribs of PDP of the present invention is within a range of from 7 to 10, whereby crosstalk of the display can be reduced as compared with a case where conventional barrier ribs containing lead, are employed.

Further, in PDP of the present invention, the barrier ribs contain no lead component and thus have a low density, and therefore, the PDP of the present invention is suitable for ever-increasing large sized PDP. Especially, it presents no substantial problem of warpage or difficulty in handling during the production process. Further, as a final product (PDP), the weight can be reduced, whereby the handling will be easy.

Especially when the glass ceramic composition as defined in claim 2 is used for the barrier ribs, the thermal expansion coefficient matches usual PDP substrates, and when barrier ribs are formed on the PDP substrates, there will be no problem of warpage or cracks in the overcoat of the primer, and the substrate scarcely undergo cracking.

Further, the shrinkage upon firing after printing is little, whereby the film thickness to be printed per operation can be increased, thus bringing about a merit that the productivity is high.

What is claimed is:

1. A plasma display panel comprising mutually opposing substrates and barrier ribs formed between adjacent pixels of a display between the substrates, wherein the barrier ribs are made of a fired product of a glass ceramic composition consisting essentially of a glass powder of a $P_2O_5$-containing type glass and a low expansion ceramic powder.

2. The plasma display panel according to claim 1, wherein said glass ceramic composition consists essentially of from 20 to 70 wt % of said glass powder and from 30 to 80 wt % of said low expansion ceramic powder, said glass powder consisting essentially of from 25 to 45 mol % of $P_2O_5$, from 0 to 50 mol % of ZnO, from 0 to 70 mol % of SnO, from 0 to 10 mol % of $Li_2O$, from 0 to 10 mol % of $Na_2O$, from 0 to 10 mol % of $K_2O$, from 0 to 20 mol % of $Li_2O+Na_2O+K_2O$, from 0 to 10 mol % of MgO, from 0 to 10 mol % of CaO, from 0 to 10 mol % of SrO, from 0 to 10 mol % of BaO, from 0 to 20 mol % of MgO+CaO+SrO+BaO, from 0 to 10 mol % of $B_2O_3$, and from 0 to 10 mol % of $Al_2O_3$.

3. The plasma display panel according to claim 1, wherein the low expansion ceramic powder is at least one member selected from the group consisting of alumina, zircon, cordierite, mullite, silica, β-eucryptite, β-spodumene and β-quartz solid solution.

4. The plasma display panel according to claim 1, wherein the barrier ribs have an average thermal expansion coefficient from room temperature to 300° C. of from $63\times10^{-7}$/°C. to $90\times10^{-7}$/°C.

5. The plasma display panel according to claim 1, wherein the barrier ribs have a dielectric constant from 7 to 10.

* * * * *